US010139207B2

(12) United States Patent
Adams

(10) Patent No.: US 10,139,207 B2
(45) Date of Patent: Nov. 27, 2018

(54) PROJECTILE HAVING INCREASED VELOCITY AND AERODYNAMIC PERFORMANCE

(71) Applicant: Richard D Adams, Madison, AL (US)

(72) Inventor: Richard D Adams, Madison, AL (US)

( * ) Notice: Subject to any disclaimer, the term of this patent is extended or adjusted under 35 U.S.C. 154(b) by 0 days.

(21) Appl. No.: 15/426,004

(22) Filed: Feb. 6, 2017

(65) Prior Publication Data

US 2017/0227339 A1 Aug. 10, 2017

Related U.S. Application Data

(60) Provisional application No. 62/291,319, filed on Feb. 4, 2016.

(51) Int. Cl.

| | |
|---|---|
| ***F42B 10/40*** | (2006.01) |
| ***F42B 10/38*** | (2006.01) |
| ***F42B 10/44*** | (2006.01) |

(52) U.S. Cl.

CPC ..... *F42B 10/40* (2013.01); *F42B 10/38* (2013.01); *F42B 10/44* (2013.01)

(58) Field of Classification Search

CPC ..... F42B 10/34; F42B 10/36; F42B 10/40; F42B 10/44; F42B 12/74

See application file for complete search history.

(56) References Cited

U.S. PATENT DOCUMENTS

| | | | | | |
|---|---|---|---|---|---|
| 2,507,878 | A | * | 5/1950 | Banning, Jr. | F41A 1/00 102/517 |
| 2,624,281 | A | * | 1/1953 | McNally | F02K 7/08 102/511 |
| 3,064,381 | A | * | 11/1962 | Vilbajo | F42B 8/04 102/483 |
| 3,620,167 | A | * | 11/1971 | Romer | F42B 14/061 102/521 |
| 3,809,339 | A | | 5/1974 | Sieling et al. | |
| 4,215,632 | A | * | 8/1980 | Sie | F42B 8/14 102/521 |
| 4,301,736 | A | * | 11/1981 | Flatau | F42B 10/34 102/501 |
| 4,327,643 | A | * | 5/1982 | Lasheras Barrios | F42B 12/32 102/473 |
| 4,362,107 | A | * | 12/1982 | Romer | F42B 10/06 102/444 |
| 4,674,706 | A | | 6/1987 | Hall | |

(Continued)

*Primary Examiner* — Stephen Johnson
*Assistant Examiner* — Joshua T Semick
(74) *Attorney, Agent, or Firm* — Mark Clodfelter

(57) ABSTRACT

A streamlined projectile is disclosed that includes a base or rear having a plurality of concentric sections located within each other at the aft of the projectile and in successively smaller sizes. Within each concentric section is a chamber having a wall perpendicular to expanding combustion gasses, with the total area of these walls being greater than an area of the rear of the projectile itself. This creates a larger projectile base for a propellant to push against and for that explosion to be held within the section chamber for a longer period than that of a standard boattail or flat-tail projectile. In addition, the concentric sections at least partially negate atmospheric drag by occupying the region behind the projectile where a partial vacuum forms, resulting in a projectile that will go faster and further for a given propellant charge.

19 Claims, 10 Drawing Sheets

(56) References Cited

U.S. PATENT DOCUMENTS

| | | | | | |
|---|---|---|---|---|---|
| 4,882,997 | A * | 11/1989 | Baxter | C06B 27/00 | 102/503 |
| 5,067,406 | A * | 11/1991 | Olson | F02K 7/105 | 102/374 |
| 5,359,938 | A * | 11/1994 | Campoli | F42B 14/061 | 102/521 |
| 7,051,659 | B2 * | 5/2006 | Tyll | F02C 7/04 | 102/374 |
| 8,109,212 | B2 * | 2/2012 | O'Dwyer | F42B 5/035 | 102/217 |
| 8,487,227 | B2 | 7/2013 | Rastegar et al. | | |

* cited by examiner

PROJECTILE HAVING INCREASED VELOCITY AND AERODYNAMIC PERFORMANCE

CROSS REFERENCE TO RELATED APPLICATIONS

This application claims the benefit of Applicant's provisional application No. 62/291,319, filed Feb. 4, 2016, which is hereby incorporated in its entirety by reference.

FIELD OF THE INVENTION

This invention relates generally to firearm and gun ammunition, and particularly to such ammunition having an increased base area for propellant to push against, resulting in increased muzzle velocity for a given amount of charge, and also producing reduced drag so that such ammunition is propelled faster and further than conventional ammunition.

BACKGROUND OF THE INVENTION

Most conventional projectiles such as bullets or artillery shells are aerodynamically shaped to increase their speed and overall performance. Most commonly, the rear of a projectile fired from a firearm, artillery or the like is either cylindrical, as is the case with most artillery shells and larger caliber bullets, or configured as a "boattail". The boattail is a truncated conical portion at the rear of a bullet, with where the conical portion begins tapering toward the rear of the bullet or projectile being a circumference around the bullet where air begins to separate from the bullet when it is in flight, causing a partial vacuum behind the bullet that creates drag.

The rear of a bullet or projectile may be configured having a recess for causing expansion of the rear of the bullet to engage rifling of a barrel and seal the bullet against the inner bore of a barrel to prevent loss of expanding gasses upon firing. Efforts have been made to eliminate or minimize drag created by the partial vacuum at the rear of a projectile by using expandable boat tails or cones, projectile shape, and tail covers in order to fill up the vacuum behind a bullet and smooth airflow immediately behind a bullet. Some projectiles such as Hall's U.S. Pat. No. 4,674,706 and Rastegar's U.S. Pat. No. 8,487,227 use a type of "tail cone" device to increase a projectile's performance by incorporating a boattail extension device to improve the aerodynamic properties at the back of the projectile. Both of these particular patents modify the aerodynamic properties of the projectile by the installation of an extending cone or layers of cones to form an overall increased aerodynamic shape in order to reduce drag. One problem with this type of design is not only the complexity of manufacturing such an expanding cone, but the higher probability of failure during its deployment due to a tremendous increase in the number of moving parts. In addition, the extreme rate of revolution of a bullet, which is typically well in excess of 100,000 RPM, may tear relatively fragile moving parts apart due to centrifugal force. For instance, a standard M16 service rifle (0.223×45) has a muzzle velocity of around 3100 feet per second with rifling of a 7 inch twist, meaning that a bullet from such a rifle rotates at around 318,900 RPM. Shrapnel that may be flung from a projectile rotating that fast would be devastating.

Another problem with this type of design is the change in center of gravity and center of pressure of the projectile while the projectile's cone is in the process of changing shapes (extending and ejecting parts, such as with the ejection of the pressure plate in Hall's design). Once the cone in these previously mentioned designs are extended (fully deployed position), there could actually be a loss of overall area for the explosion to push off against, especially since the lack of outer side walls of the concentric cones would not capture much of the explosive force, and may even allow some of the explosive force to move in between the expanding rings (cones), deforming the cone altogether. These types of expandable cones also use release mechanisms that can malfunction or not operate properly in such high force situations, such as with a standard bullet or artillery round.

The present invention overcomes these deficiencies with a fixed cone system allowing for a predictable/known center of gravity, a predictable/known center of pressure, ease of manufacturing with minimal parts, no moving parts, no loss of parts during flight, while maintaining a generally aerodynamic rear cone design, and providing for an overall increase in the base of the bullet for an increase area that an explosion can push off against.

Some other designs, such as Sieling's U.S. Pat. No. 3,809,339 attempt to overcome the moveable/extendable boat tail or cone by the use of what the inventor calls "stings," these stings, while eliminating some of the drag caused by disrupted airflow at the aft of the projectile, do not assist the projectile's performance by increasing the explosion "push-off" area, as well as having no chamber walls to contain the explosive force. Additional embodiments of the current invention can incorporate changing the shape of the cone sections to attain different aerodynamic characteristics, while still increasing the "push-off" or base, overall area by the use of the cone chambers. Along with the overall increase in the area of the base of the projectile (push-off area), this area is housed within walls to hold the explosion for a longer period of time (chambers), with less "bleed-off" of the explosion over the edge of each base, as would happen with the sting designs of Sieling and the cone designs of Hall and Rastegar. The instant invention incorporates hollowed out cones to not only increase the projectile base, but also to hold the explosion in order to gain the full benefit of the explosive force. The instant invention's cone sections can also be incorporated into other projectile designs as such designs emerge.

SUMMARY OF THE INVENTION

A projectile fired from a barrel by highly pressurized gas developed independent of the projectile is disclosed. The projectile is configured having at least one chamber at its aft portion, the chamber having rear walls generally coincident with a circumference of the projectile body. A member in the chamber has a circular region at the open end of the chamber, forming an annular opening that allows the highly pressurized gas into the chamber and exert force against a forward wall of the chamber, assisting in propelling the projectile forward.

DETAILED DESCRIPTION OF THE PREFERRED EMBODIMENT

Figure 1:
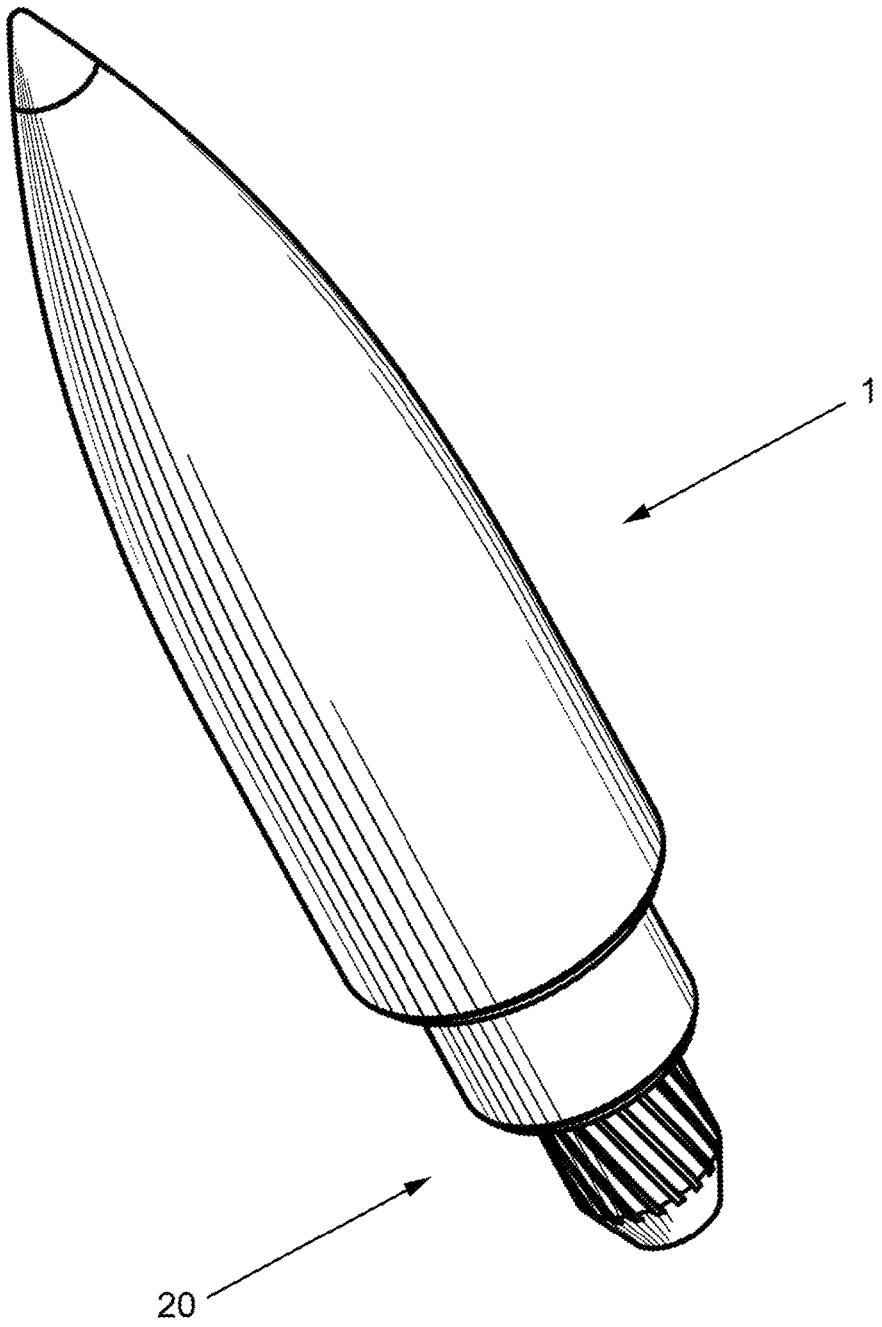
FIG. 1 is a side perspective view of one embodiment of a projectile of the instant invention.

Referring to the drawings, FIG. 1 pictorially depicts a front perspective view of a projectile 1 with a portion 20 of the instant invention attached to its aft section. Portion 20, as will be explained, has a larger surface area for propulsion gasses to push against than a projectile of the prior art of the same diameter, enabling projectile 1 to be propelled with a greater velocity for the same amount of propellant as a prior art projectile having the same weight. In addition, portion 20 extends from a rear of projectile 1 into a region where a partial vacuum forms during projectile flight, filling such region and promoting smoother airflow around a rear of the projectile.

Figure 2:
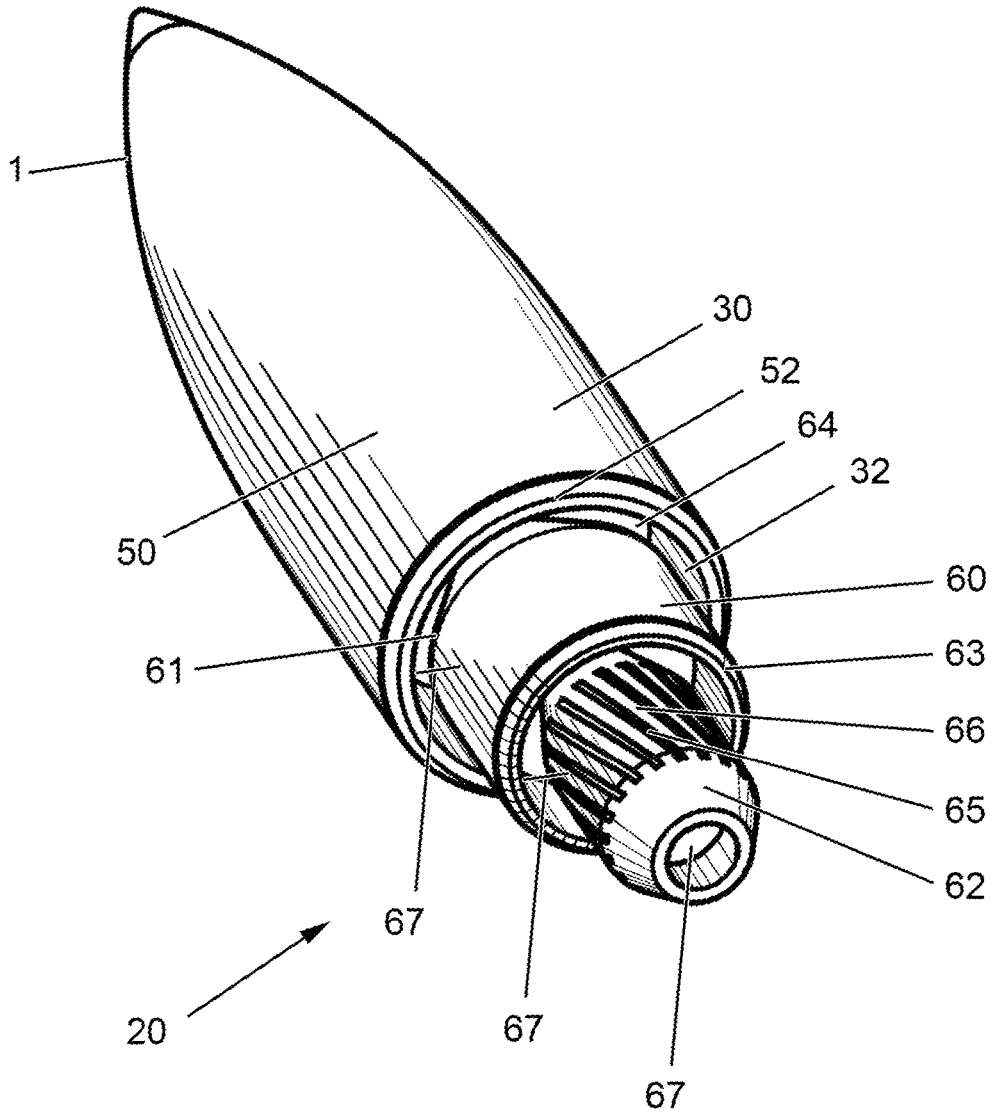
FIG. 2 is a rear perspective view of the embodiment of FIG. 1.
Figure 4:
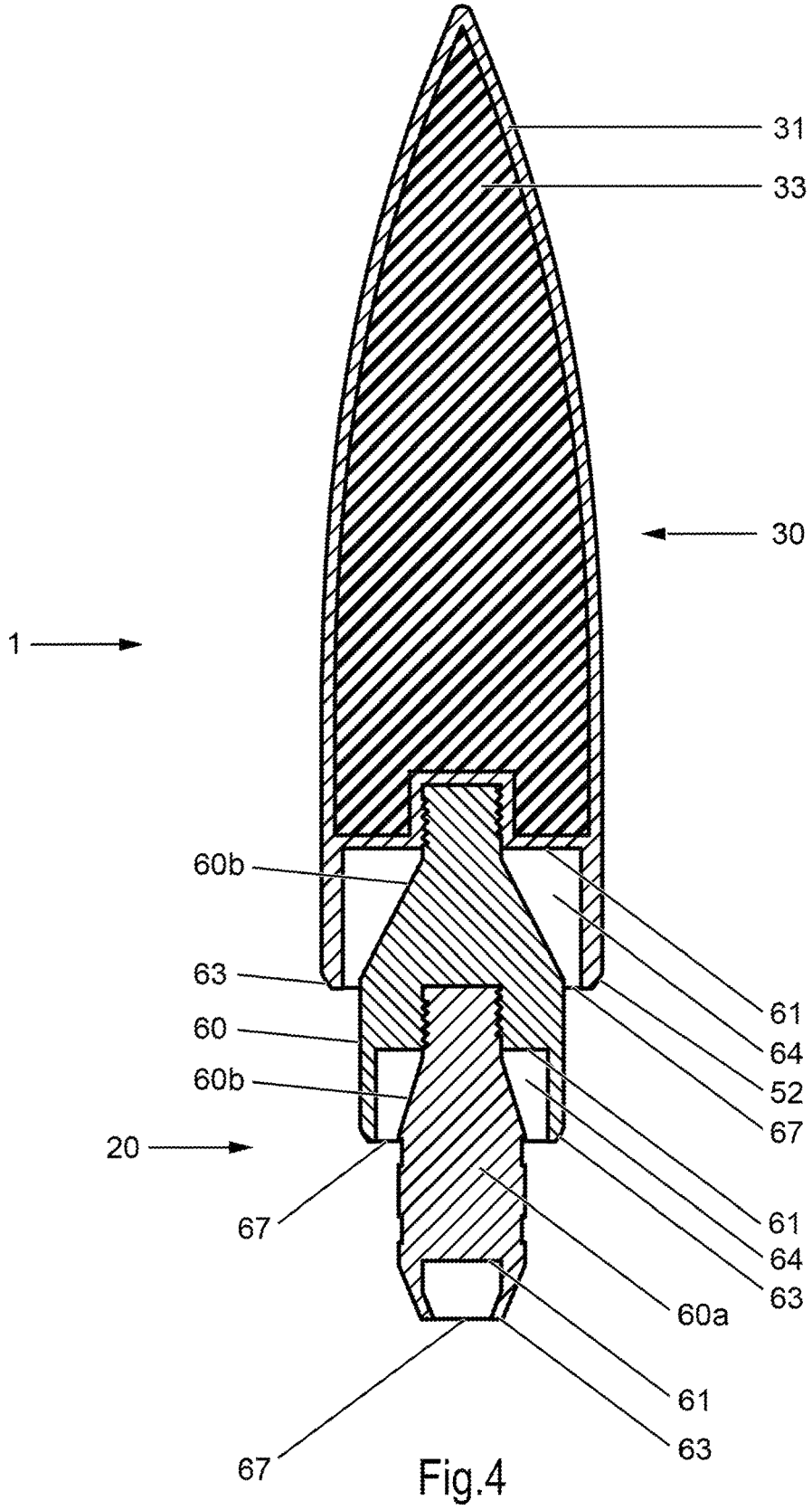
FIG. 4 is a sectional view of the projectile of FIG. 1.

FIG. 2 depicts an aft perspective view of the projectile assembly 1, as well as the components of portion 20, which is attached to or constructed integral with a rear of projectile body assembly 30. A trailing edge of the projectile body assembly 30 includes an extended outer jacket wall 32, which forms a first conical pressure chamber 64 (FIG. 4). Walls of chamber 64 are thin, and generally coincident with a circumference of projectile 1. In embodiments where the wall of chamber 64 is coincident with a circumference of projectile 1, wall 32 may be expandable upon firing the firearm so that an outer portion of wall 32 engages lands and grooves of a barrel and seals between the barrel and the outer portion of wall 32 to prevent combustion gasses from escaping around the projectile. In other embodiments, a wall thickness of chambers 64 may be selected to be thin but sufficiently strong to just avoid deformation, and be slightly less in circumference than the circumference of projectile 1 so that the outer chamber wall does not touch the barrel. Here, the outer circumference of the projectile seals against the barrel, as by lands and grooves of the barrel cutting into the projectile body. As should be apparent, the wall of chambers 60 are thus thin so as to provide as much volume as possible for chambers 64. Depth of chambers 64 is such that the projectile as a whole is not made unstable for its particular length, rotation rate and weight. In addition, the material of the wall of chamber 64 may be of a stronger material than a jacket of the projectile so that the chamber wall may be made thinner without deforming. This allows a maximum of gas to be packed into the chamber as the projectile travels down the barrel. An aft section of wall 32 is trimmed with a bearing surface heel 52.

Figure 3:
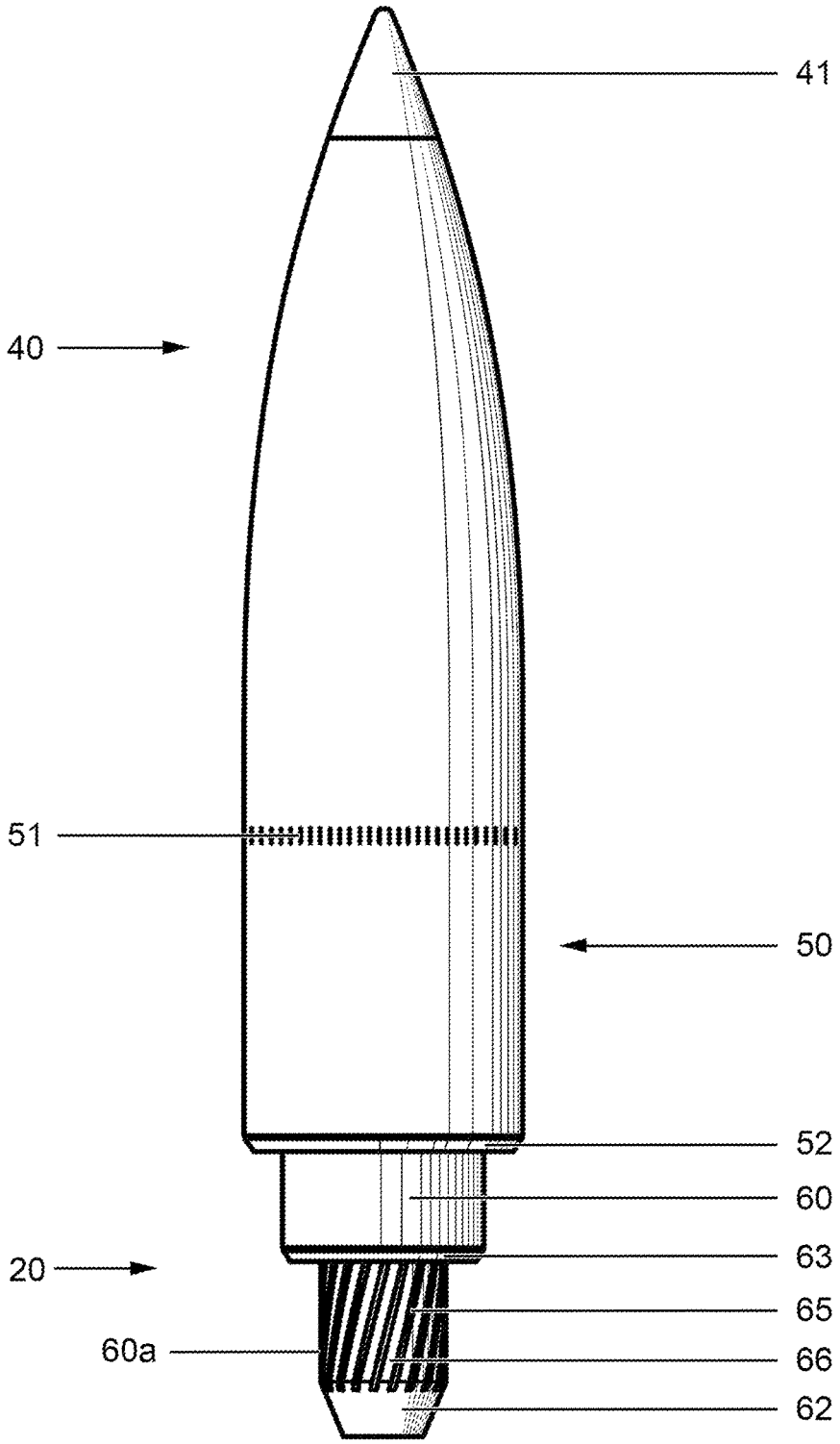
FIG. 3 is a side perspective view of the embodiment of FIG. 1.

Referring to FIGS. 2, 3, and 4, within pressure chamber 64 and attached to rear or base 61 of projectile assembly 1 is portion 20 comprising conical portion 60 and conical portion 60*a*. While conical portions 60, 60*a* are disclosed, such portions may be of other configurations, such as having a square or cylindrical cross section, or a cone that tapers in the opposite direction to that shown. In any case, a region at the rear of portion 20 is circular, and extends into close proximity with wall 32 at the open end of chamber 64. As such, portions 60, 60*a* each have an edge that projects toward an inner wall of chambers 64 at an open end of chambers 64, forming an annular opening that opens into chambers 64. Each concentric portion 60, 60*a* has an annular projectile base opening 67 that opens into a cone pressure chamber 64. Each cone portion would have a cone heel 63 at the edge of each cone section. The final section of the staggered cone assembly can be fitted with lands 66 and grooves 65 (FIG. 3) that may assist with projectile rotation at slower velocities and may also have a more pronounced cone heel 62 to assist in the aerodynamic shape of the overall portion 20. Additional embodiments can incorporate raised fins or slats (not shown) in place of the lands 66 and grooves 65. Other embodiments of portion 20 can incorporate more or fewer cone sections depending on the desired flight characteristics and size (diameter) of the projectile.

FIG. 3 and FIG. 4 are a side and cross sectional view of the present invention. The projectile consists of two primary sections that will be referred to as the projectile head 40 and the bearing surface 50 (FIG. 2). Around most typical small arms projectiles and in another embodiment, a cannelure 51 can be used to assist in the placement and sealing of a standard bullet and cartridge case, but does not necessarily have to be incorporated into the present invention. Head 40 of projectile 1 includes an ogive consistent with the type of projectile, e.g. small arms, pistol, artillery and so forth. The ogive terminates at a projectile tip 41. Bearing surface 51 includes a cylindrical region into which lands and grooves of a barrel cut in the instance of spin stabilized projectiles. As shown in this embodiment, there is no boattail region as with conventional small arms projectiles. In some embodiments, driving bands may be employed to engage rifling of a barrel rather than a cylindrical region. A bearing surface heel 52 may be provided at the rear of the projectile to somewhat smooth airflow around a rear of the projectile. In other embodiments, such as pistol projectiles, bearing surface heel 52 may be omitted.

As can be seen in FIG. 4, projectile body assembly 30 can be further broken down showing the projectile outer jacket 31 and the projectile core 33. Where larger caliber bullets and artillery rounds are constructed in accordance with the present invention, core 33 may include a charge, such as an explosive charge, a smoke or other indicator charge, an incendiary, or other charge. A triggering mechanism for activating the charge would also be provided. Various projectile jacket and core designs can be used with the present invention depending upon the user's needs. As noted, portion 20 comprises one or more conical portions 60, 60*a* mounted coaxially to projectile assembly 1 at its most aft section. Also as noted, projectile assembly 1 has a recessed area that receives conical portion 60 and forms pressure chamber 64. Portion 60 may have its own recessed portion or chamber 64 that also receives a conical portion 60*a*. Each chamber 64 is configured having a forward wall 61 against which propellant gasses push directly forward, the gasses entering chamber 64 via annular opening 67.

In the embodiment shown in FIG. 4, a conical wall 60*b* of respective portions 60, 60*a* forms an inner wall of chambers 64. As noted, in other embodiments, conical walls 60*b* may be replaced by straight walls or walls that taper in an opposite direction to walls 60*b*. With this construction, it is believed that force developed by pressurized gas entering chamber 64 and impinging against walls 61, which are perpendicular to a long axis A of generally cylindrical body 30, to drive the projectile forward will be greater than forces developed by gas pressure applied to conical walls 60*b*. This is because gasses entering chambers 64 are restricted by the annular openings and impinge on the perpendicular walls 61 as an annular jet as pressure in the chambers equalizes with pressure within the barrel. When optimized, and in one embodiment, a gap of the annular opening is sized such that pressure in the chambers comparatively slowly rises and becomes equal or close to equal to barrel pressure just as or just prior to the projectile leaving the barrel. With gas pressures in a firearm being on the order of 50,000 PSI or so, an annular jet as described would exert considerable force against walls 61. In addition, such gas pressure would also react or push against the resistance of the annular gaps as pressures in the chambers are equalizing so that the gaps function as a wall perpendicular to the barrel to propel the projectile forward as in prior art projectiles. As such, the annular gap between the inner edge of chamber 64 and portion or portions 60, 60*a* may be a few thousandths of an inch, such as 0.002 inch to about 0.005 inch or more for a small arms projectile to about 0.01 inch to about 0.015 inch or more for an artillery shell. In other embodiments the annular gap may be larger, depending on projectile characteristics and desired performance. The amount and type of charge may also be adjusted so that barrel pressure constantly builds as long as the projectile is in the barrel. In this case, pressure would never equalize between the chamber and barrel. Additionally, in some embodiments, wall 32 of chamber 60 are where the explosive gases from a typical projectile propellant would form, so wall 32 may be of a thickness so that the skirt of bearing region 50 (FIG. 2) is deformed outward to engage lands and grooves of barrel rifling while eliminating any bleed-off of the explosion around the side of the projectile. Further, annular openings 67 and chambers 64, being selectively sized so as to relatively slowly equalize with barrel pressure as the projectile is travelling down the barrel, cause propellant gas to be stored in the chamber, which as noted may be on the order of 50,000 PSI or higher, releases the stored gasses as annular jets when the projectile clears the barrel. This should also provide a boost or kick to the projectile in the manner of a rocket after the projectile clears the barrel. Since the projectile is also spinning at a high rate, and is thusly stabilized, such a boost should not affect accuracy or stability of the projectile. Here, consistent with projectile design, the center of gravity and center of pressure of the projectile would be adjusted for maximum stability. In another embodiment, and as shown in FIG. 4*b*, chambers 64 may be partially filled with a propellant P in order to provide a similar boost to the projectile. In this case, chambers 64 may be made larger to accommodate the extra propellant while retaining the advantages described above. In addition, and as shown in FIG. 4*b*, the shape of chambers 64 are such that as a propellant compound P burns, the surface area of the propellant increases, generating an increasing amount of propellant passes that are passed through annular openings 67, further accelerating or at least maintaining speed of the projectile. Such propellant may be selected to burn at a different rate, such as slower, than the propellant powering the projectile while in the barrel, so that the projectile is further accelerated after it leaves the barrel. In yet another embodiment, a burn rate of a propellant P or other combustible material similarly shown in FIG. 4*b* in the chambers 64 may be selected to provide combustion gasses to a region of partial vacuum just behind the projectile in order to equalize the region of partial vacuum with atmospheric pressure. This serves to reduce or eliminate drag that would otherwise occur due to the partial vacuum forming directly behind a projectile in flight. In embodiments where an additional propellant charge is provided in one or more of chambers 64, the charge may be in a channel, separate cavity or on a wall so as to not be directly impinged by the annular jet.

The present invention in FIG. 3 and FIG. 4 depicts a staggered coned assembly 20 in its preferred position at a rearward end of a projectile. As an explosion behind the projectile is ignited to propel the projectile assembly 1, a portion of the explosion is guided through annular openings 67 and impinges against the bases 61 of the projectile and conical elements 60, 60*a*, propelling the projectile forward. Resistance to gas flow at the annular openings due to sizing of the openings presents resistance that aids in propelling the projectile forward as chambers 64 fill with gas. The rearmost chamber in conical portion 60*a* has a wall 61 perpendicular to the push of gasses and functions similarly to a conventional firearm projectile. Of course, gas pressure also acts on all other walls, such as heels 63, that produce a forward push of the projectile. The most aft position of the staggered cone assembly 20 is the tail heel 62 of conical member 62*a*, and has its own perpendicular wall 61 and the lands 66 and grooves 65, which may interact with an airstream at the rear of the projectile and assist in rotating the projectile at slower speeds. These lands and grooves would have a twist rate of at least that of the rifling of the barrel or shorter.

In one example of a projectile constructed in accordance with the instant invention, consider the projectile of FIG. 4 being a 20 mm cannon round. Assuming that the cavity walls are 1 mm thick, then a surface area of the largest perpendicular wall 61 in the base of projectile 1 would be 56.52 sq mm (18×3.14). If the area where member 60*a* is inserted into wall 61 is 5 mm in diameter, or an area of 15.7 sq. mm, then the total surface area to be impinged on by an annular jet is 40.82 sq mm. Likewise, where chamber 64 of member 60 is 16 mm in diameter, wall 61 thereof would have a surface area of 34.54 sq mm. for an annular jet to impinge on. The wall 61 in the end of member 60*a*, if 5 mm, would have an area of 15.7 mm to receive expanding gasses. As such, a total area of 75.36 sq mm is available for receiving the impulse of annular jets of gasses, in addition to 15.7 sq mm to receive a push from the propellant gasses. A total area of these walls that receive the gasses is about 91.06 sq. mm. This total is actually slightly higher as the 1 mm thickness of the walls was ignored. In contrast, a conventional 20 mm cannon shell has a rear area of 62.8 sq mm. As such, a round of the instant invention may have about 33% more surface area for propellant gasses to act against. An annular gap of perhaps 0.010-0.015, or even greater, may be sufficient to accelerate such a round above its normal velocity.

Figure 4A:
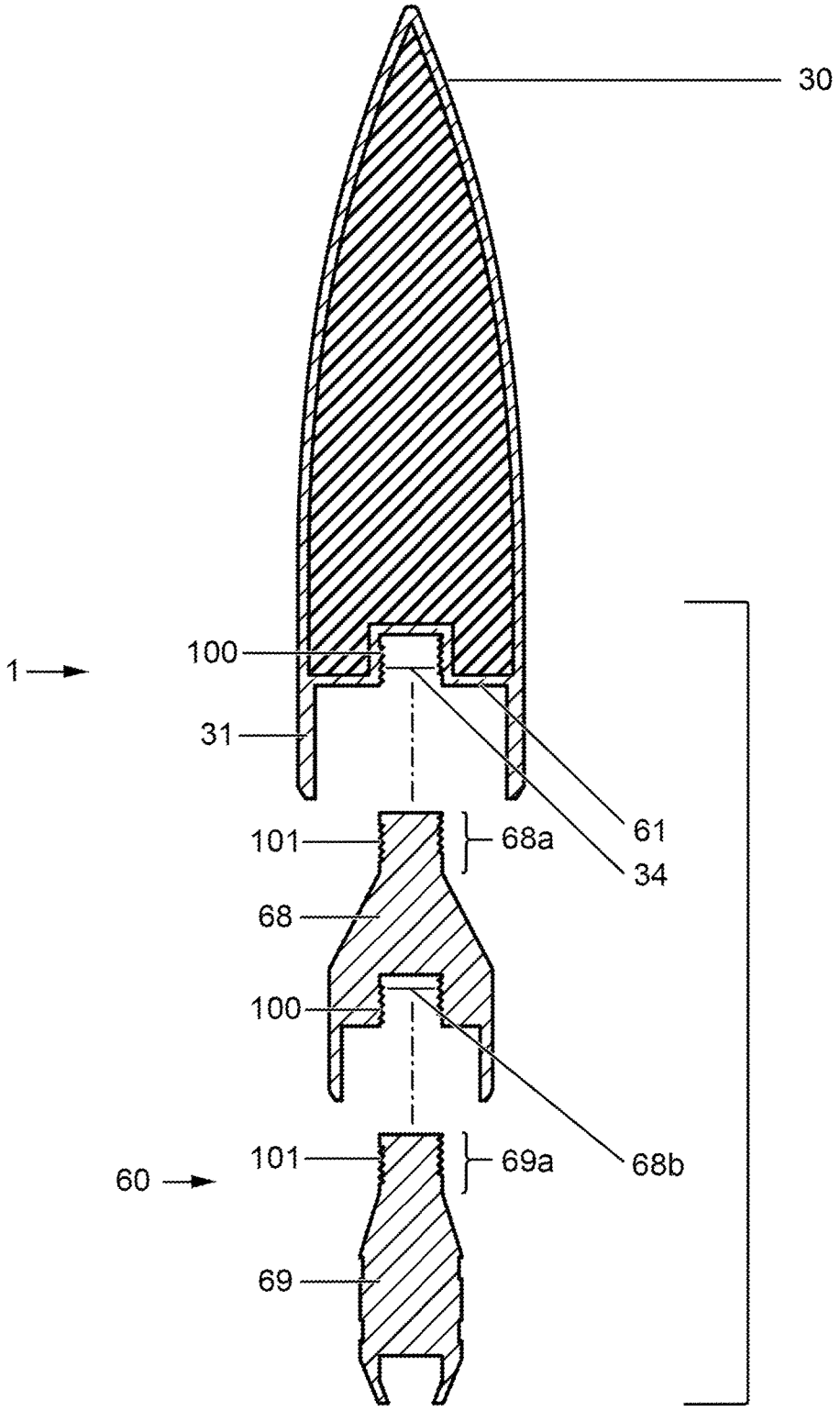
FIG. 4*a* is a sectional view of the projectile of FIG. 1 showing disasembled components thereof.
Figure 4B:
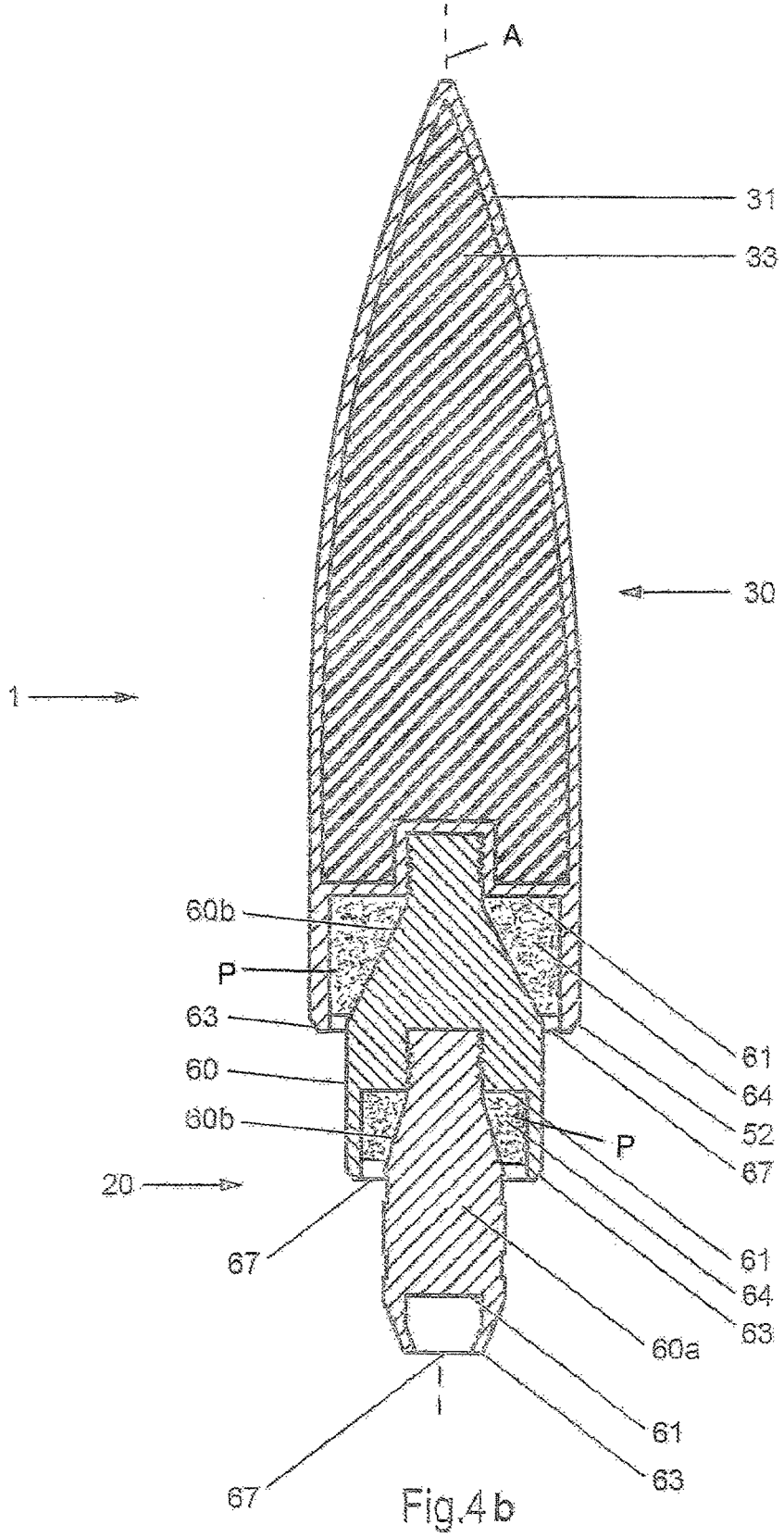
FIG. 4*b* is a sectional view of the projectile of FIG. 1 showing another embodiment of the invention.

FIG. 4*a* depicts a side cross sectional view of the projectile assembly 1 in another embodiment. This embodiment allows for the staggered cone assembly 60 to be manufactured in separate sections; the base cone section 68 and the secondary cone section 69. In this embodiment, the projectile body assembly 30 is the mounting point for the staggered cone assembly separate sections (68 and 69) using the harder projectile outer body 31 as a base for the staggered cone assembly sections. In this embodiment the projectile body assembly would be modified with female threads 100 section at its base 61 in the base cone mounting point 34. This can be accomplished, in this embodiment, by threadably engaging the threaded area of base cone mounting stem 68*a* into the threaded base cone mounting point 34. In order to accurately position portions 68 and 69, walls 70*a*, 70*b*, 70*c* and 70*d* may be constructed so that when walls 70*a*, 70*b*, 70*c* and 70*d* are abutted, conical portions 68 and 69 are in exact coaxial alignment with projectile 30 so that projectile stability is not affected. Such construction of walls 70*a*, 70*b*, 70*c* and 70*d* may be flat (shown), a conical protrusion on one of walls 70*a*, 70*b*, 70*c* and 70*d* and a mating conical recess on the other respective wall, a convex wall fitting into a mating concave wall, a stepped protrusion on one wall fitting into a stepped recess in a respective stepped recess, or any other way of perfectly axially aligning portions 68, 69 with projectile 30. The base cone section 68 is screwed into the base 61 of the projectile 30 with male threads 101 to engage walls 70*a*, 70*b*, 70*c* and 70*d*. The secondary cone section 69, in this embodiment, is then connected to the base cone female mounting point 68*b* via the secondary cone male mounting stem 69*a* in the same manner. The number of cone sections can be either increased or decreased depending upon the particular flight characteristics that are desired, and possibly the caliber of the projectile. This embodiment is advantageous in that different cone sections having different diameters are possible in order to adjust size of the annular gap in accordance with different desirable flight characteristics. As should be apparent, larger caliber projectiles and artillery shells may accommodate more cone sections.

Another embodiment of the present invention could incorporate a weakened mounting area 34 or a "shear assist" mechanism (not shown) for the staggered cone assembly causing it to bend or separate upon or after impact. This separation would cause the projectile to possibly change direction as well as the possibility of creating another wound channel if used as a bullet, or additional shrapnel if used with an artillery round or the like. Any deformation of portion 20 (FIG. 1) will cause the projectile to change direction. In other embodiments, and as noted above, portion 20 may be constructed integral with projectile 30, as by injection molding, casting, or the like. In yet other embodiments, portion 20 may be constructed to fall away after the projectile leaves the barrel, although benefits of drag reduction would be lost. In these embodiments, a rear portion of projectile 1 near the chamber walls may be shaped as a boattail or have an ogive profile. In yet other embodiments that fall away, a conventional projectile may be simply provided with a mounting area 34 to which one or more sections 68, 69 may be added.

Figure 5:
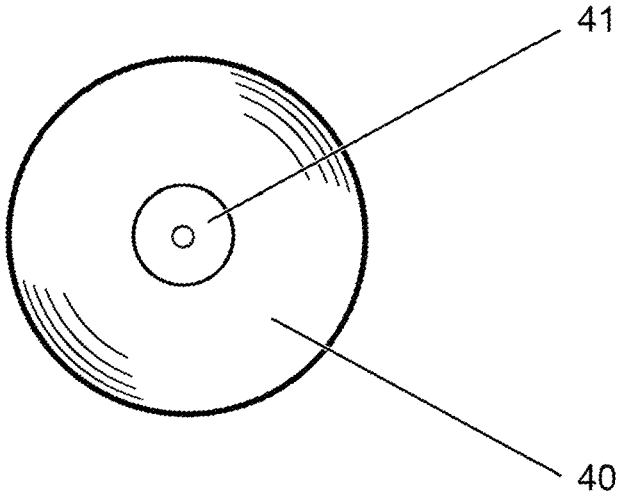
FIG. 5 is an end view of a front of the projectile of FIG. 1.

FIG. 5 is a top view of the present invention showing the upper section, or the projectile head 40 and the projectile tip 41.

Figure 6:
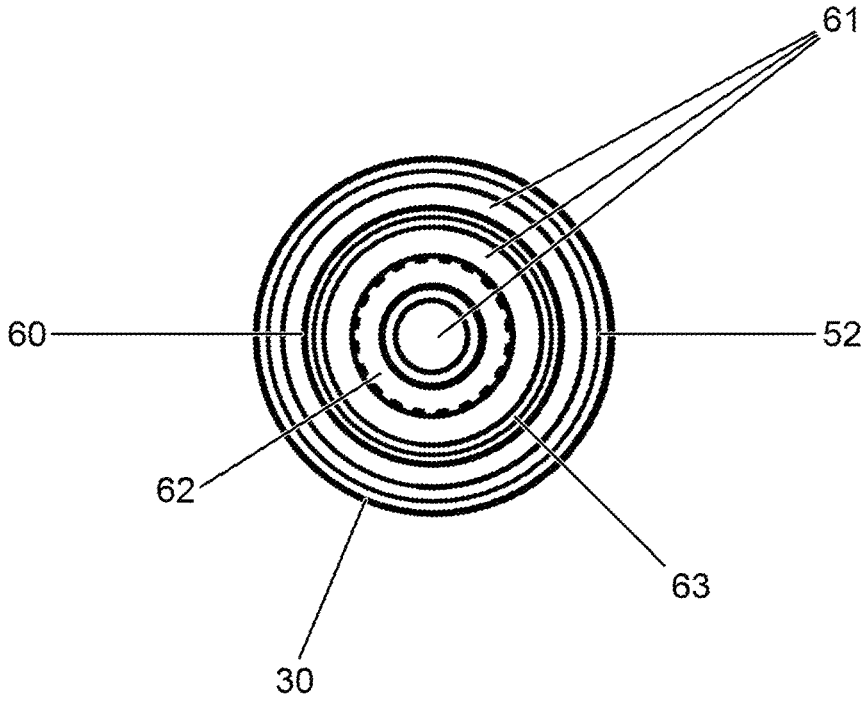
FIG. 6 is a rear view of the projectile of FIG. 1.

FIG. 6 depicts a bottom view of the present invention showing the bearing surface heel 52, the tail heel 62, the cone heel 63, the staggered cone assembly 60, and projectile body assembly 30 bases 61.

Figure 7:
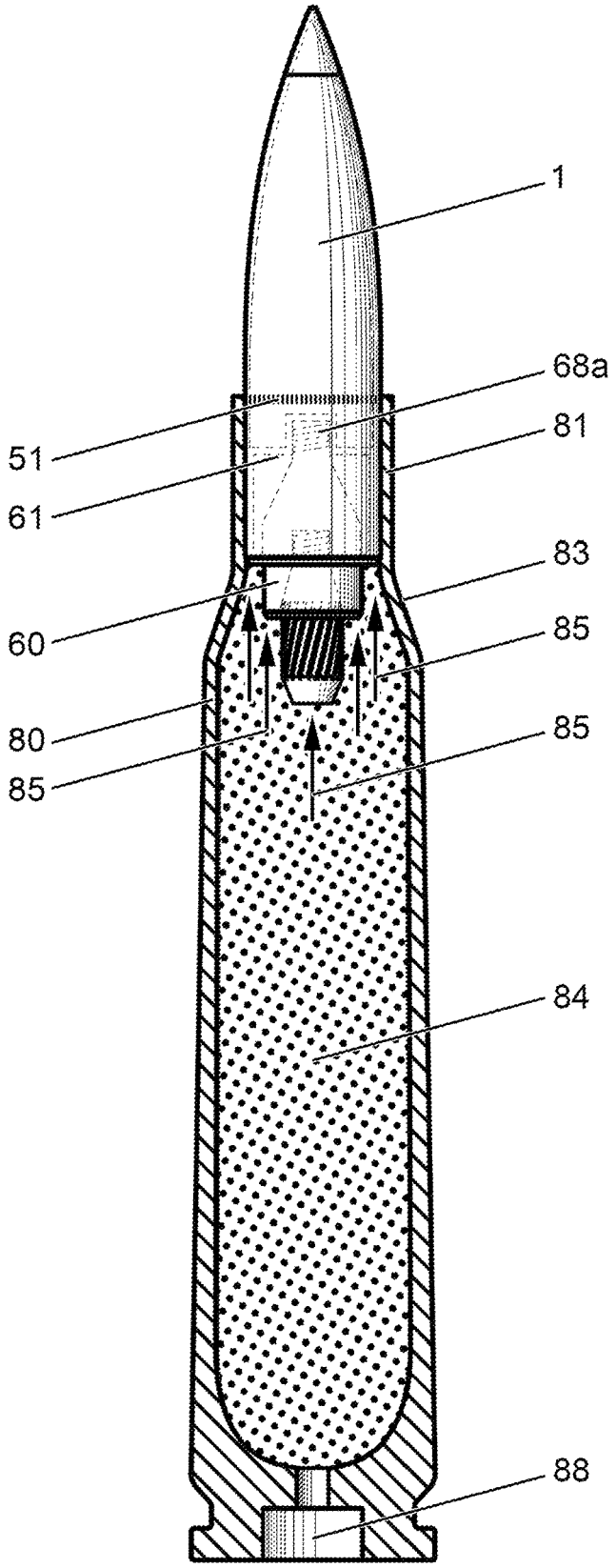
FIG. 7 is a sectional view showing a projectile of FIG. 1 in a cut-away cartridge.

FIG. 7 is a side, cross sectional view of the present invention, the projectile assembly 1, mounted to a typical cartridge case or projectile case body 80. The projectile assembly 1 in this particular embodiment is mounted within the case neck 81 by the assistance of the projectile's cannelure 51. The staggered cone assembly 60 is shown mounted to the aft of the projectile's base 61 via the base cone male mounting stem 68*a* (shown by broken lines). The projectile assembly 1 is mounted in the case neck 81, just above the case shoulder 83. The case shoulder 83 acts as a Venturi to speed up expanding gasses and assists in directing propellant gasses 85 into chamber 64 when the propellant 84 is discharged by an impact against the primer 88 mounted at the base of the projectile case body 80, propelling the projectile assembly 1 forward out of the projectile case body 80. As noted, annular gap 67 (FIG. 4) presents resistance to very high pressure gasses, and causes an annular jet of hot, expanding gasses that impinge on forward walls 61 of the cone assembly in order to propel the projectile faster than otherwise be possible with a conventional projectile of the same weight, diameter, material and bearing area. In other words, all things being equal, Applicant's projectile will travel faster and be less susceptible to atmospheric drag due to a partial vacuum forming behind the projectile.

Figure 8:
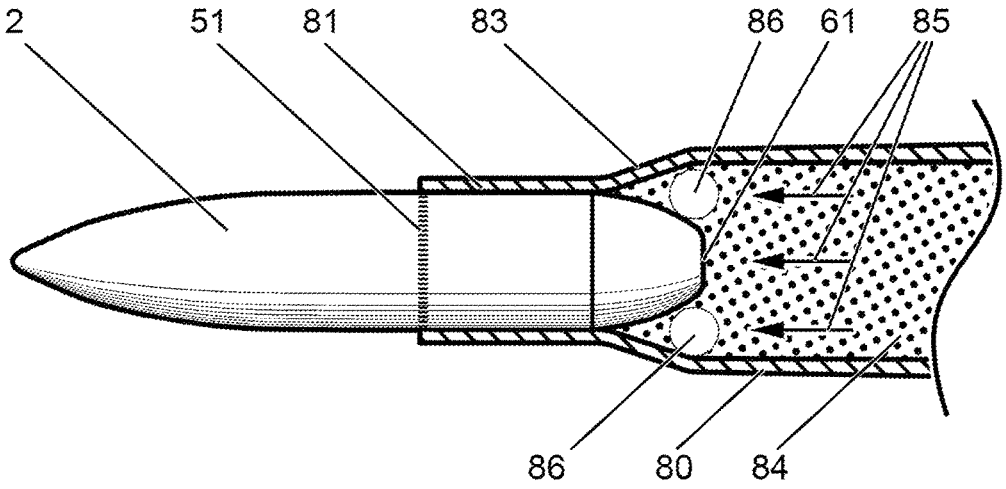
Fig.8 PRIOR ART
FIG. 8 is a sectional view showing operational details of a prior art projectile and a cut-away cartridge.

FIG. 8 depicts a conventional boattail standard projectile 2, which is typical for a pistol or rifle cartridge. This figure depicts the standard projectile 2 installed into the projectile case body 80 sitting in the case neck 81 with the assistance of the cannelure 51. As the propellant 84 is ignited, the propellant explosion 85 attempts to expel the standard projectile 2 from the projectile case body 80. A typical boattail projectile, as depicted in this figure, has a reduced base 61 when compared to the present invention. When the propellant explosion 85 moves towards the base 61, it also encounters the side walls of the standard projectile 2 and the case shoulder 83, producing a negative propellant explosion impact area 86. The angled boattail of a standard projectile does not have a completely flat base for the propellant explosion to push off against that may reduce the overall potential force that could be produced against the projectile, as some of the force is directed inward toward the axis of the projectile.

Figure 9:
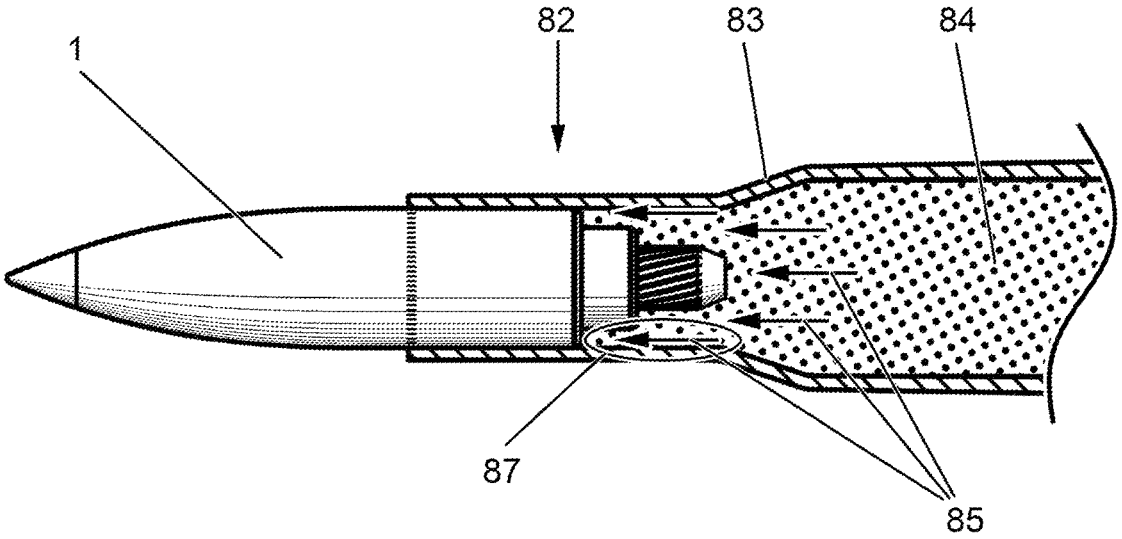
FIG. 9 is a sectional view showing operational details of a projectile of the invention in a cut-away cartridge.

FIG. 9 depicts the present invention with an elongated case neck 82 (alternative embodiment) specifically designed for the present invention (projectile assembly 1). When the propellant 84 is ignited, the propellant explosion 85 moves towards the projectile assembly 1 being directed by the case shoulder 83 into an extended or elongated case neck 82, creating a Venturi effect in the elongated narrow chamber 87 between an inner wall of the case and an outer wall of the first cone portion 60 (FIG. 4). Compression caused by the Venturi speeds up the gasses and causes an annular jet of superhot gas to impinge against the forward wall 61 of projectile 30. Simultaneously, a second annular jet is forced through the annular gap 67 between an inner wall of cavity 64 in a rear of portion 60 and conical wall 60*b* of portion 60*a*, and gas pressure pushes directly against cavity 67. These combined actions will optimize gas pressure exerted on the projectile assembly 1, thus increasing the projectile's forward velocity in flight. As noted above, additional velocity may be gained by gas pressure that accumulates in cavities or reservoirs 64 (FIG. 4) as the projectile is travelling down a barrel, which gas pressure being released in the manner of a rocket after the projectile exits the barrel. Here. the tapered cavities also create a Venturi effect and speed up the annular gas jets emerging from the cavities. Also as noted, this embodiment would have carefully sized annular openings 67 (FIG. 4) and sized cavities 64 in order to allow substantially the same gas pressure to accumulate in cavities 64 as pressure in the barrel while the projectile is in the barrel, while allowing the stored gas pressure in the cavities to provide a boost or kick to the projectile after it is released from the barrel. In a related embodiment, the interior of projectile 30 (FIG. 4) may be provided with a recess or hollowed region, with a relatively small opening communicating between the hollowed region and burning propellant. This would allow gas pressure, which as noted may be 50,000 PSI or so, to accumulate within the hollowed region of the projectile and be released in the manner of a rocket after the projectile exits the barrel. The relatively small opening, in some embodiments, may be configured similar to a rocket nozzle to optimize gas flow and thrust. Also as an additional benefit, such construction would eliminate that drag due to a partial vacuum forming behind the projectile while in flight. Here, smaller and lighter projectiles, such as 0.223 and 0.177 caliber projectiles, may benefit more because of their light weight.

Figure 10:
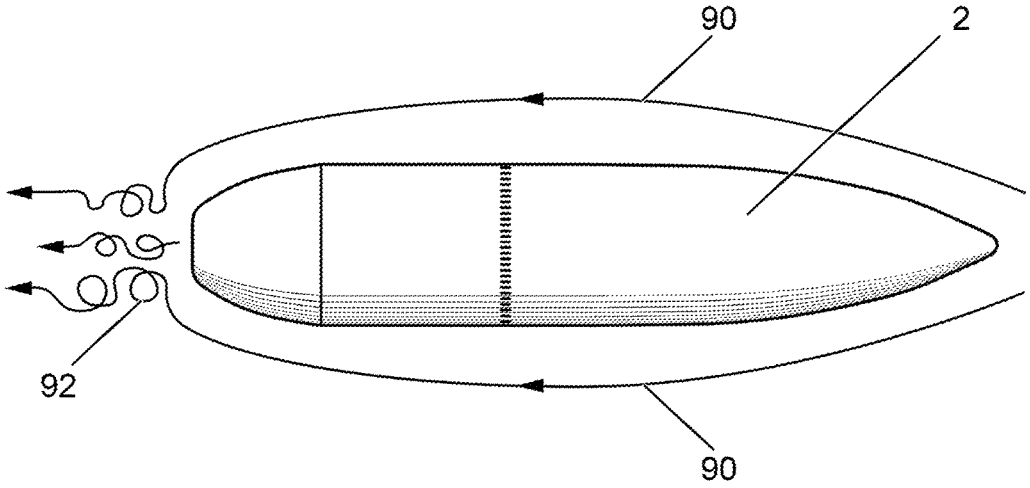
Fig.10 PRIOR ART
FIG. 10 is a diagrammatic view showing a prior art projectile in flight.
Figure 11:
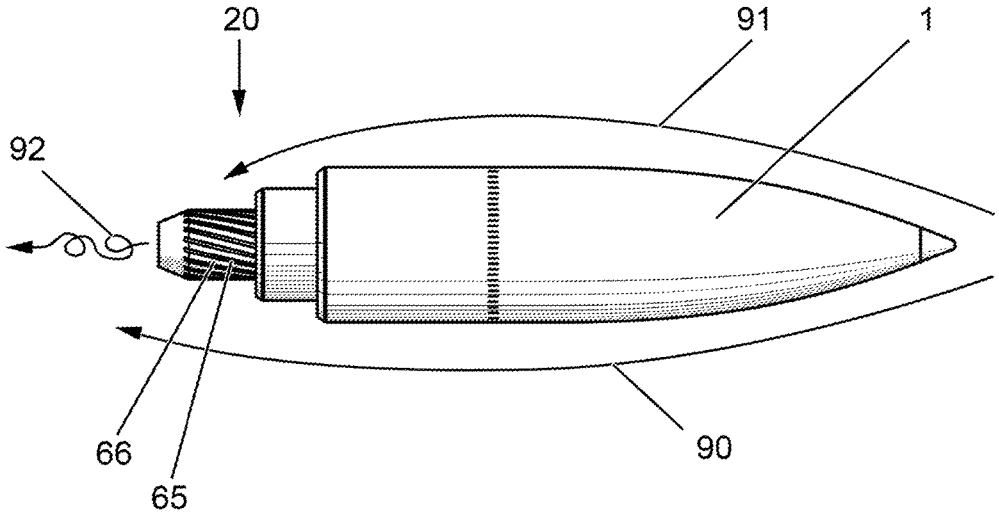
FIG. 11 is a diagrammatic view showing a projectile of the instant invention in flight.

FIG. 10 depicts a standard projectile 2 in flight with the airflow depicted as in-flight projectile airflow 90. In this depiction, one can see the disrupted airflow and partial vacuum 92 at the most aft end of the projectile. The larger the projectile base, the more disrupted airflow 92 that will be present. FIG. 11 shows the present invention (projectile assembly 1, in-flight, as well as the in-flight projectile airflow 90; the aft section or boattail section 20 of the present invention reduces the amount of disrupted airflow 92 by creating an extension of the boattail design, while not reducing the base 61 (not shown in this drawing) of the projectile, but actually increasing the surface area of the base of the projectile. The present invention in FIG. 11 depicts the terminal projectile airflow 91 of some embodiments as the projectile slows. It is believed that the lands 66 and grooves 65 at the aft of the projectile will assist in the projectile's rotation as slower airflow begins to make contact with the aft section of the projectile; air contact with the aft section of the present invention will allow for further spinning of the projectile, thus assisting with accuracy (extends the rotation time of the projectile). In other embodiments, such as small arms projectiles, lands 66 and grooves 65 may not be needed.

As noted, and with reference to small arms projectiles, a gas-producing compound may be provided in portion 20 or in a rear cavity 67 (FIG. 4) in order to fill a partial vacuum behind projectile 30. This should eliminate drag due to such a partial vacuum. In addition, also as noted, the annular gaps would be carefully sized so that one or more annular gas jets are formed for substantially the time the projectile is travelling the length of the barrel.

Having thus described my invention and the manner of its use, it is apparent that incidental changes may be made by those skilled in the relevant arts that fairly fall within the scope of the following appended claims, wherein I claim:

1. A projectile, and a barrel through which said projectile is fired by pressurized gas developed separately and independently from said projectile, said projectile comprising:

a generally cylindrical body, a chamber at a rear of said generally cylindrical body, said chamber having an open rear at said rear of said generally cylindrical body, said chamber defined by a first circumferential wall coincident with an outer diameter of said generally cylindrical body, a wall in said chamber opposite said open rear of said chamber, said wall perpendicular to a long axis of said generally cylindrical body and receiving force from said pressurized gas via said open rear of said chamber, a member in said open rear of said chamber, said member having a circular region extending toward said first circumferential wall of said chamber, said circular region and said first circumfrential wall defining an annular opening between said first circumferential wall of said chamber and said circular region, said annular opening being around said rear of said generally cylindrical body, said chamber communicating via said annular opening with said pressurized gas in said barrel, a second chamber in a rear of said member, said second chamber having a second open rear at a rear of said member, with a second circumferential wall of said second chamber being sufficently strong so as to prevent distortion by said pressurized gas in said barrel, said second circumferential wall of said second chamber extending around a circumference of said member, a second member in said second chamber, said second member having a second circular region extending toward said second circumferential wall of said second chamber, said second circumferential wall and said second circular region defining a second annular opening between said second circumferential wall of said second chamber and said second circular region of said second member, said second annular opening being around said second open rear of said member, said second chamber communicating via said second annular opening with said pressurized gas in said barrel.

2. The projectile and barrel as set forth in claim 1 wherein said annular opening and said second annular opening are sized so that pressure in said chamber becomes equalized with pressure from said pressurized gas in said barrel at or near an end of said barrel.

3. The projectile as set forth in claim 1 wherein said second chamber is further defined by a second wall opposite said second annular opening of said second chamber, said second wall perpendicular to a long axis of said generally cylindrical body and receiving force from said pressurized gas via said second annular opening.

4. The projectile as set forth in claim 3 wherein said second member further comprises a third chamber having a third wall perpendicular to said long axis of said generally cylindrical body for receiving force from said pressurized gas in said barrel.

5. The projectile as set forth in claim 4 wherein said member further comprises a conical portion tapered toward said wall perpendicular to said long axis of said generally cylindrical body, and said second member further comprises a second conical portion tapered toward said second wall perpendicular to said generally cylindrical body, with said circular region of said member being at a widest portion of said conical portion and said second circular region being at a widest portion of said second conical portion.

6. The projectile as set forth in claim 5 wherein said chamber has an inner wall defined by said conical portion of said member, and said second chamber has an inner wall defined by said second conical portion of said second member.

7. The projectile and barrel as set forth in claim 4 wherein said wall, said second wall and said third wall have a combined surface area greater than a surface area of a rear of a conventional projectile of the same caliber.

8. The projectile as set forth in claim 7 wherein said combined surface area is approximately 33% larger than said surface area of said rear of said conventional projectile of the same caliber.

9. The projectile and barrel as set forth in claim 1 wherein said chamber and said second chamber are configured to accumulate and store said pressurized gas while said projectile is in said barrel, and expel accumulated and stored said pressurized gas after said projectile leaves said barrel, providing a boost or kick to said projectile.

10. The projectile and barrel as set forth in claim 4 wherein at least one of said chamber, said second chamber and said third chamber are at least partially provided with a combustable material that, when ignited, produces a gas to fill a partial vacuum behind said projectile during flight, thus reducing or eliminating drag.

11. The projectile and barrel as set forth in claim 4 wherein at least one of said chamber, said second chamber and said third chamber is at least partially filled with a propellant that when ignited, provides acceleration to said projectile after said projectile leaves said barrel.

12. The projectile as set forth in claim 1 wherein said first circumferential wall is configured to be expanded outward to seal against said barrel by said pressurized gas.

13. A projectile, and a barrel through which said projectile is fired by pressurized gas developed separately and independently from said projectile, said projectile comprising:

a generally cylindrical body, a chamber at a rear of said generally cylindrical body, said chamber having an open rear at said rear of said generally cylindrical body and defined by a first circumferential wall coincident with an outer diameter of said generally cylindrical body, a wall in said chamber opposite said open rear of said generally cylindrical body, said wall perpendicular to a long axis of said generally cylindrical body and receiving force from said pressurized gas via said open rear of said chamber, a member in said open rear of said chamber, said member having a circular region extending toward said first circumferential wall of said chamber, said circular region and said first circumferential wall defining an annular opening between said first circumferential wall of said chamber and said circular region, said annular opening being around said rear of said generally cylindrical body, a second chamber in a rear of said member, said second chamber having a second open rear in said member, with a second circumferential wall of said second chamber being sufficently strong so as to prevent distortion by said pressurized gas in said barrel, said second circumferential wall of said second chamber extending around a circumference of said member, a second wall in said second chamber opposite said rear of said member, said wall being perpendicular to a long axis of said generally cylindrical body and receiving force from said pressurized gas via said second open rear of said second chamber, a second member in said second chamber, said second member having a second circular region extending toward said second circumferential wall of said second chamber, said second circumferential wall and said second circular region defining a second annular opening between said second circumferential wall of said second chamber and said second circular region of said second member, said second annular opening being around said rear of said member, said said second chamber communucating via said second annular opening with said pressurized gas in said barrel.

14. The projectile and a barrel as set forth in claim 13 wherein said member comprises a conical portion and said second member comprises a second conical portion, with a narrowest part of said conical portion and said second conical portion centrally mounted in said chamber and said second chamber, respectively, and a widest part of said conical portion and said second conical portion being said circular region defining said annular opening and said second circular region defining said second annular opening, respectively, so that said chamber and said second chamber are each an annular chamber with a conical inner wall.

15. The projectile and barrel as set forth in claim 14 further comprising a third wall at a rear of said second member, said third wall perpendicular to said long axis of said generally cylindrical body, said wall, said second wall and said third wall having a combined surface area about 33% greater than a surface area of a rear of a conventional projectile of a same caliber as said projectile.

16. The projectile and barrel as set forth in claim 14 wherein said annular opening and said second annular opening are configured to create annular jets of said pressurized gas into said chamber and said second chamber, said jets impinging against said wall and said second wall of said chamber and said second chamber, said annular opening and second annular opening further sized so that a pressure of said pressurized gas in said barrel equalizes with pressure in said chamber and said second chamber at or near an end of said barrel from which said projectile emerges, and said pressurized gas is accumulated and stored in said chamber and said second chamber to be released and give said projectile a boost after said projectile leaves said barrel.

17. A projectile and barrel as set forth in claim 13 wherein said member and said second member extend behind said generally cylindrical body into a region where a partial vacuum forms during flight of said projectile, smoothing airflow around a rear of said projectile.

18. The projectile and barrel as set forth in claim 14 further comprising a propellant in said chamber and said second chamber, for accelerating said projectile after said projectile leaves said barrel.

19. The projectile and barrel as set forth in claim 13 further comprising a combustable material in said chamber and said second chamber, to provide combustion gasses to a region of partial vacuum just behind the projectile in order to equalize the region of partial vacuum with atmospheric pressure.

* * * * *